United States Patent [19]

Hein et al.

[11] Patent Number: 4,552,342

[45] Date of Patent: Nov. 12, 1985

[54] METHOD AND APPARATUS FOR PREHEATING AND CHARGING SCRAP IN STEELMAKING

[75] Inventors: Karl Hein, Moers, Fed. Rep. of Germany; Markus Hubig, Hergenrath, Belgium; Helmut Seroka, Bochum, Fed. Rep. of Germany

[73] Assignee: Klöckner CRA Technologie GmbH, Duisburg, Fed. Rep. of Germany

[21] Appl. No.: 583,354

[22] Filed: Feb. 24, 1984

[30] Foreign Application Priority Data

Mar. 5, 1983 [DE] Fed. Rep. of Germany ..... 3307940

[51] Int. Cl.[4] ..... C21B 7/00

[52] U.S. Cl. ..... 266/175; 75/43; 75/44 S; 266/142; 266/165

[58] Field of Search ..... 75/43, 44 S; 266/175, 266/142, 165

[56] References Cited

U.S. PATENT DOCUMENTS 3,336,020 8/1967 Palsak ..... 75/43

FOREIGN PATENT DOCUMENTS 3107548 7/1982 Fed. Rep. of Germany .

2071290 9/1981 United Kingdom ..... 266/175

OTHER PUBLICATIONS

Laws, W. R., "Prospects for Scrap Preheating for the Basic Oxygen Furnace", Steel Times, pp. 679–681 (Sep. 1972).

*Primary Examiner*—Peter D. Rosenberg

*Attorney, Agent, or Firm*—Watson, Cole, Grindle & Watson

[57] ABSTRACT

Scrap metal for steelmaking in a converter is preheated by a heating installation and subsequently charged into a charging trough. The preheating takes place in a separate furnace which is aligned parallel to the charging trough. The furnace can be brought to an emptying position in such a way that the preheated scrap can fall from the preheating furnace and still retain its orientation.

11 Claims, 8 Drawing Figures

METHOD AND APPARATUS FOR PREHEATING AND CHARGING SCRAP IN STEELMAKING

BACKGROUND OF THE INVENTION

1. Field of the Invention

This invention relates to a method and apparatus for preheating and charging scrap metal for steel making in a converter or the like. More particularly, a heating installation is provided for scrap preheating and an elongated, transportable trough is designed for the charging of the preheated scrap into the converter.

2. Description of the Prior Art

Prior art apparatus and methods are described in the publication "Prospects for Scrap Preheating for the Basic Oxygen Furnace," Steel Times, Sept. 1972, pp. 679–682. According to this publication, scrap is heated in standard charging troughs, then charged into a converter. As is well known, in this type of scrap preheating outside the converter, the main unit proper, i.e., the converter, is unloaded. Scrap that has been heated to 500° to 600° and possibly even 800° C. or more, can be charged into the converter at any time during a converter cycle, e.g., prior to or after the addition of pig iron. Compared to adding non-preheated scrap for cooling directly into the converter, the tap-to-tap time of the converter is shorter and the disadvantages encountered in the prior art when adding scrap to the converter are non-existent. A particular advantage of the charging of preheated scrap is that at 700° C. and above, scrap exhibits a certain softness so that it requires less space compared to non-preheated scrap.

In a prior art process for scrap preheating in a charging trough, scrap is first fed into the charging trough, whereupon a hood-like cover provided with heaters is applied to the filled charging trough. The heaters, typically oil burners, are used to heat the scrap. Upon removal of the hood, the charging trough can be transported to the converter and emptied therein. This method and the equipment operating according thereto have the disadvantage that the charging trough is heated at the same time as the scrap. This results in an enormous energy loss, since the mass of the charging trough is somewhat comparable with the mass of the scrap charged into it. Roughly speaking, the charging trough absorbs about 50% of the heat supplied, but the heat absorbed by the charging trough is lost for subsequent steel production. There is also the danger that the charging trough will distort and scale.

Although preheating scrap directly within the charging trough has advantages as far as the transport of scrap is concerned, such preheating has drawbacks with respect to the associated energy consumption and the wear of the charging troughs. Yet another disadvantage of such a prior art process is the potential for oxidation of the scrap from direct contact with the heating flame.

SUMMARY OF THE INVENTION

The major object of the invention is to improve the above-noted apparatus and methods so as to overcome the associated disadvantages mentioned above and to provide for a more energy-efficient preheating of scrap without thermally loading the charging troughs. This object is achieved by a heating installation provided as part of an elongated furnace which is closable on all sides and which has essentially the same length as and a comparable cross section to the charging trough. The furnace is initially opened in a charging position along its top side. After the scrap has been preheated, the furnace assumes an emptying position that enables automatic emptying. The charging trough is disposed parallel with the furnace and is located below the furnace.

The object of the invention is further achieved by charging scrap from above into a furnace and preheating the scrap with the heating installation of the furnace. The charging trough and the furnace, after preheating the scrap, are brought to a transfer position, in which the furnace is in an emptying position so that the preheated scrap slides automatically from the furnace, and in which the trough is located below and parallel with the furnace.

During this process, the charging troughs are not heated directly by the heating installation, but absorb only a certain portion of the heat from the preheated scrap. However, this loss is substantially smaller than the energy loss in the prior art method. Furthermore, the preheating occurs in a much more energy-efficient manner in a furnace closable on all sides, that is to say, in a separate apparatus. Thus, the furnace can be designed specially and independently of the mechanical requirements imposed on the charging trough for optimum scrap preheating. More particularly, the furnace can be lined with refractory material to provide much better heat insulation than that possible with the charging trough of the prior art. All this leads to a considerable saving of energy.

In a preferred embodiment of the invention, the furnace is designed with a U-shaped cross section and is arranged to rotate about a longitudinal axis extending through its center of gravity. The furnace is covered by a closing wall arranged alongside the U-shaped section and is provided with refractory material. The furnace can be brought to three working positions by turning it about its longitudinal axis. The first working position is a charging position in which the longitudinal opening of the furnace lies above or on top of the furnace. In this position the furnace is not covered by the closing wall. Thus, the furnace can be charged by a crane from above, like the charging trough in the prior art method.

The second working position is a heating position, for which the furnace is turned about 70° from the charging position. Thus, the furnace still is not completely perpendicular with respect to its original vertical position. Due to the rotating movement, the longitudinal furnace opening is covered automatically by the stationary closing wall and the furnace is closed. The scrap is preheated in this position. Starting from this point, the furnace is rotated to the emptying position in which the longitudinal furnace opening lies at the bottom of the furnace. At the beginning of this third working position, the emptying position, the preheated scrap slides down the furnace and falls into a charging trough disposed below the furnace opening while still retaining its orientation and essentially its dual relative disposition. That is, the scrap is maintained in the same relative shape after it has been emptied and thus does not fall apart during emptying.

BRIEF DESCRIPTION OF THE DRAWINGS

Various other objects, features and attendant advantages of the present invention will be more fully appreciated as the same becomes better understood from the following detailed description when considered in connection with the accompanying drawings, in which like reference characters designate like or corresponding parts through the several views and wherein.

DETAILED DESCRIPTION OF THE PREFERRED EMBODIMENT

Figure 3:
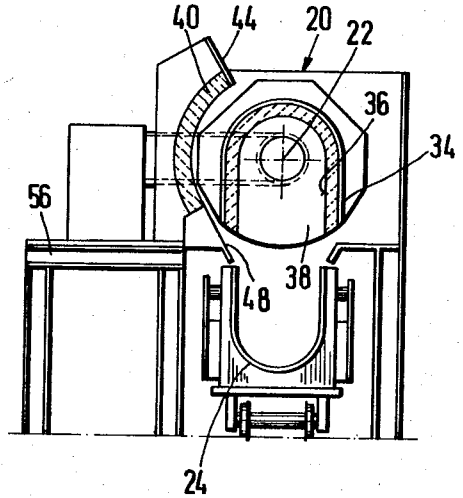
FIG. 1, 2 and 3 are front views of a furnace rotatable about its longitudinal central axis, the charging trough being disposed below the furnace and the sequence of figures corresponding to the sequence of operating positions.
Figure 2:
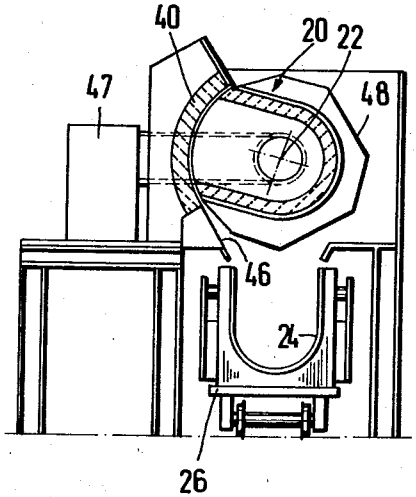
Figure 1:
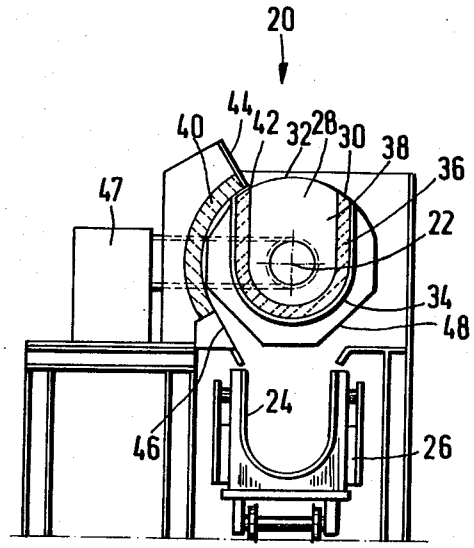

FIGS. 1 through 3 illustrate a specific example of an apparatus and system for preheating and charging scrap for steelmaking in a converter. The preheating of the scrap occurs in a furnace 20 from which the preheated scrap is passed down into a charging trough 24 by turning the furnace 20 about a longitudinal axis 22. The trough 24 is disposed directly or perpendicularly below the longitudinal axis 22 and is carried by a railway car 26 moving on rails (not shown) at right angles to the plane of the drawing.

The furnace 20 has a U-shaped cross section with sides dimensioned slightly greater than its width by about 10–20%. The longitudinal axis 22 about which the furnace is pivoted lies in the center of a circular arc forming the bottom of the furnace. The upper aperture areas 30 which define the longitudinal opening 28 of the furnace 20 are disposed farthest from the longitudinal axis 22, thus determining the diameter of the circle of motion 32 of the furnace 20. As shown in FIG. 1, the aperture areas 30 are curved in accordance with this circle of motion 32.

The furnace 20 is internally dimensioned to correspond to the charging trough 24. The internal section of the furnace 20 corresponds exactly to the internal section of the charging trough 24. Both interiors are also of the same length, typically 11 meters.

The furnace 20 includes an outer metal jacket 34 in the form of a U-shaped trough, an inner refratory lining 36, two end walls 38, as well as a closing wall 40 which is similarly built and is shaped as a sector of a hollow cylinder. The inner radius of the closing wall 40 follows or coincides with the circle of motion 32. The closing wall 40 extends over an angle of arc which is dimensioned with allowance to completely cover the longitudinal opening 28 as shown in FIG. 2. The center of curvature of the inner surface of closing wall 40 lies on the longitudinal axis 22 of the furnace 20.

Closing wall 40 is arranged in angular extent such that its upper edge 42 is essentially in alignment with the inner edge of the left aperture area 30 of furnace 20 in its charging position so that, together with an obliquely applied baffle plate 44 that protects the upper edge 42, a filling chute is formed as shown in FIG. 1. A second baffle plate 46 is applied to the lower edge 46 of closing wall 40 which prevents objects from getting into the space between closing wall 40 and charging trough 24. The furnace 20 is arranged to pivot about its longitudinal axis 22 via drive mechanism 47. A pivot or swivel angle of 180° is sufficient for pivoting furnace 20 as shown in FIGS. 1 through 3.

In accordance with FIGS. 1 through 3 the method for preheating and charging scrap in steelmaking is carried out as follows. With furnace 20 in the charging position depicted in FIG. 1, wherein longitudinal opening 28 lies above the interior of the furnace, scrap can be charged into the furnace 20. The charging takes place in a known manner fully analogous to the direct charging of a charging trough known from the prior art. As soon as furnace 20 is filled, it can be rotated from its vertical charging position shown in FIGS. 1, to the heating position illustrated in FIG. 2.

In the heating position, the furnace 20 is closed on all sides. The heating occurs by convection. A heating installation, or a suction device is provided at both end walls 38 of the furnace 20. Hot gas or hot air is introduced longitudinally into the furnace 20 through the heating installation, the heating medium being forced or exhausted through an opening in an end wall 38 into the furnace interior and issuing from the furnace interior through outlet openings in the area of the side walls of the furnace 20. To discharge the exiting fuel gases, the furnace is provided with a polygonal covering 48. Preferably, the outlet openings are arranged in the bottom of the furnace and, when viewed from the direction of flow of the fuel gases, the openings have an increasing cross section. As a result, all of the scrap is forced to flow through and short-circuit currents are prevented from developing via paths with a low aerodynamic drag.

Advantageously, the heating is performed with CO-rich converter gas which is burned in the heating installation outside of the furnace 20 proper. The hot waste gases produced flow through the furnace space proper, as described earlier, and are discharged through the outlet openings with different flow sections. This indirect heat supply by a hot gas and without direct contact with a flame has the advantage that the scrap to be heated is not oxidized. To rule out any danger of scrap oxidation, oxygen is supplied in stoichiometric deficiency for the combustion of the fuel gas, i.e., converter gas in particular, so that the fuel gas flowing into the furnace 20 does not contain any oxygen.

In addition to the indirect scrap heating by hot waste gases in a combustion chamber, the scrap can also be heated directly by flue gases. The apparatus for direct heating can be of simple design and, due to the additional heat transfer by radiation, has a higher efficiency than that of indirect heating. However, with direct heating, oxidation of the scrap being heated cannot be ruled out.

In the position shown in FIG. 2, the furnace 20 has rotated to a position of about 60° to 80°, preferably 70°, relative to its original vertical position shown in FIG. 1. As a result, the scrap remains essentially in the furnace 20 proper and exerts a lower pressure on its stationary closing wall 40 than would be exerted in a horizontal position of the furnace 20.

After the preheating, the scrap can remain in the furnace 20 as long as is necessary in the position depicted in FIG. 2, i.e., because the heat losses in this position are at a minimum. An advantage of this method is the capability of storing preheated scrap during a certain period of time.

To empty the furnace 20, it is turned as shown in FIG. 3 to a 180° position relative to the vertical charging position illustrated in FIG. 1. At the start of the emptying process, i.e., during the rotation of the furnace and prior to reaching the 180° position shown in FIG. 3, the preheated scrap slides down along the second baffle plate 46 into the charging trough 24. To prevent the impact forces and loads from damaging the rails of the railway car 26 possibly the railway car 26 itself as a result of the heavy scrap parts falling from the furnace 20 into the charging trough 26, the charging trough 24 is slightly lifted from the railway car 26, for example, by a hydraulic lifting gear. As soon as the preheated scrap is in the charging trough 24, the scrap should immediately be charged into the converter without delay.

Figure 5:
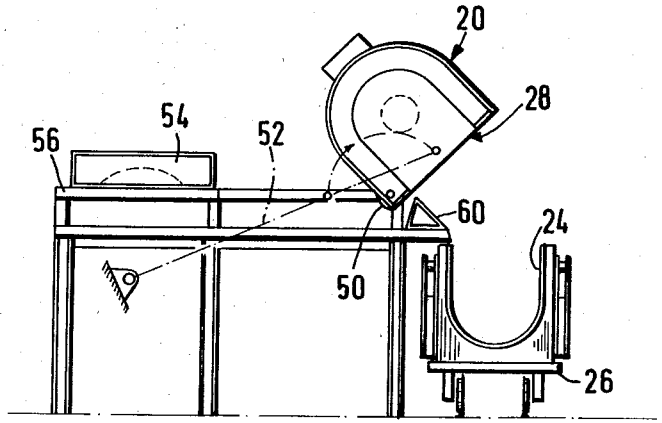
FIGS. 4 and 5 are front views of a system with a tilting furnace.
Figure 4:
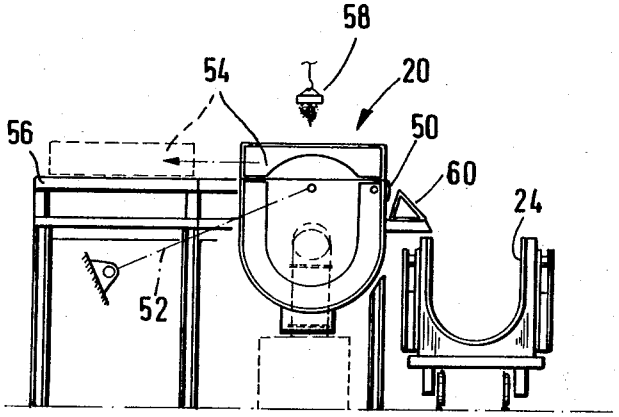

In another specific example shown in FIGS. 4 and 5, the furnace 20 is perpendicular or upright both in the charging and in the heating positions as depicted in FIG. 4. The furnace 20 has, as in the previous example, a U-shaped design and has the same inside dimensions as the charging trough 24. Starting from the position shown in FIG. 4, the furnace can rotate about an outer swivel axis 50, typically an eccentric swivel or pivot pin, and be brought to the emptying position shown in FIG. 5. To this end, a force which may be produced by a hydraulic cylinder acts along a line 52. The furnace has a removable cover 54 which, as shown by the dotted line in FIG. 4, is put on a platform 56 if the furnace 20 is charged by a crane 58.

Figure 8:
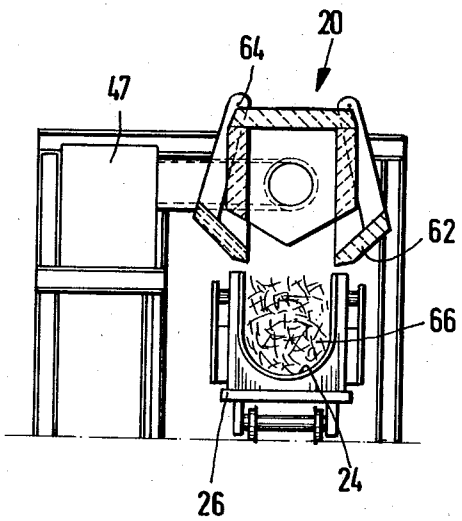
FIGS. 6, 7 and 8 are front views of a system with a swing-aside bottom below which the trough is located.

FIG. 4 shows the heating position in solid lines. A ramp 60 prevents the occurrence of a gap between the inner wall of the furnace 20 and the charging trough 24 as shown in FIG. 5. This second example differs from the first example in that in the charging and heating positions the furnace is at one side of the charging trough 24, while in the first specific example it is installed above the charging trough 24. The same applies to the third example illustrated in FIGS. 6 through 8 wherein the furnace must be installed above the charging trough 24.

In this third example, the furnace has a pivoted bottom 62. The furnace is designed to be in axial symmetry in the manner of a crane shovel. Two equally formed, substantially L-shaped furnace parts can be pivoted about overhead lateral pivot pins 64 so that the bottom parts 62 swing aside to the left or to the right and the preheated scrap 66 can fall into the charging trough.

Figure 7:
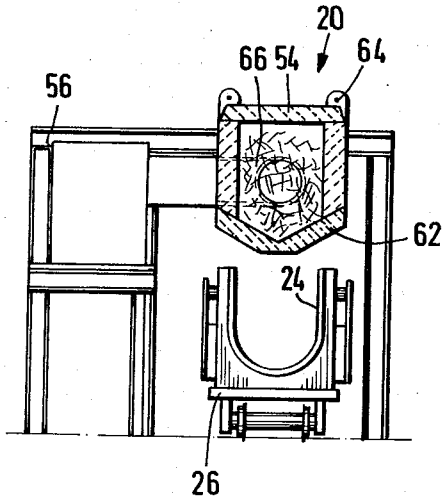
Figure 6:
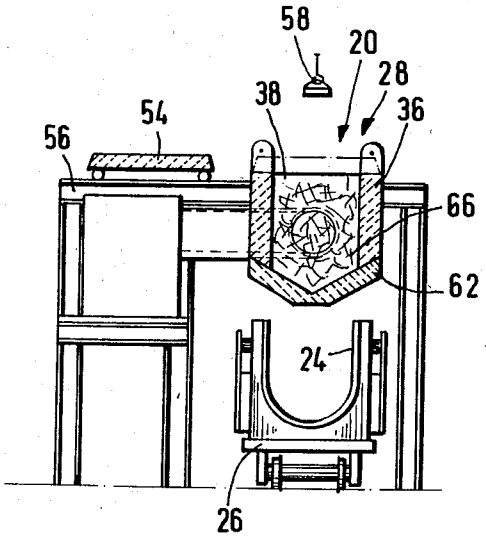

FIG. 6 shows the charging position, in which a removable cover 54 has been removed from the longitudinal opening 28 and put on a platform 56, so that charging can be initiated. In the heating position shown in FIG. 7, the furnace is closed on all sides and heating can be effected as above described. FIG. 7 shows the emptying position of the furnace 20. The L-shaped furnace parts are swung outwardly about their pivot pins 64 and the bottom parts 62 do not obstruct preheated scrap to fall into the charging trough 24.

Obviously, numerous modifications and variations of the present invention are possible in light of the above teachings. It is therefore to be understood that within the scope of the appended claims, the invention may be practices otherwise than as specifically described herein.

What is claimed as new and desired to be secured by Letters Patent of the United States is:

1. An apparatus for preheating and then charging scrap metallic materials into a steelmaking converter, said apparatus comprising an elongated furnace which includes an elongated heating chamber therein, an elongated opening for enabling scrap metallic materials to be supplied to and removed from said heating chamber, and means for enabling the scrap metallic materials in said heating chamber to be heated, said elongated furnace defining an imaginary longitudinal axis therethrough, covering means for said elongated opening and thus enclosing the heating chamber in said elongated furnace, support means mounting said elongated furnace such that said imaginary longitudinal axis therethrough is horizontal, said support means enabling said furnace to rotate about a pivot axis which is parallel to said imaginary longitudinal axis from a charging position wherein its elongated opening is generally upwardly directed to a discharging position wherein its elongated opening is generally downwardly directed, and an elongated transportable charging trough positionable below and alignable with said elongated furnace, said elongated charging trough including a storage chamber therein and an elongated mouth, said elongated mouth enabling heated scrap metallic materials which are discharged from said elongated furnace when in its discharging position to pass into said storage chamber and enabling the heated scrap metallic materials to thereafter be removed therefrom and charged into a steelmaking converter, said storage space having a volume at least equal to the volume of the heated chamber in said furnace and said elongated mouth having a length and width at least equal to the length and width of said elongated opening of said furnace.

2. The apparatus of claim 1, wherein said closing wall comprises a hollow-cylinder sector shape.

3. The apparatus of claim 1, further comprising an upper baffle plate connected to said closing wall for facilitating the charging of scrap materials into the elongated opening of said elongated furnace when in its charging position and a lower baffle plate bridging a space between a lower edge portion of said closing wall and an upper edge portion of the elongated mouth of said charging trough to prevent spillage of the heated scrap metallic materials from said elongated furnace as it is rotated to its discharge position.

4. The apparatus of claim 1, wherein said furnace further comprises a bottom section arranged to pivot open about a plurality of pivot pins.

5. The apparatus of claim 1, wherein said furnace comprises a central point and wherein said transfer position of the apparatus said central point is disposed above said charging trough.

6. The apparatus as defined in claim 1, wherein said elongated heating chamber and said elongated opening together define a U-shaped cross section.

7. The apparatus as defined in claim 6, wherein said pivot axis is coincident with said imaginary longitudinal axis.

8. The apparatus as defined in claim 7, wherein the rotation of said elongated furnace about said pivot axis causes the opening thereof to define an imaginary circle of motion, and wherein said covering means comprises a curved, elongated closing wall which is located to cover said elongated opening when said elongated furnace has been rotated to a point between said charging position and said discharging position.

9. The apparatus as defined in claim 1, including means connected to said elongated furnace to cause it to rotate about said pivot axis.

10. The apparatus as defined in claim 9, wherein said covering means is movable over said elongated opening of said elongated furnace when said elongated furnace is in its charging position.

11. The apparatus as defined in claim 10, wherein said pivot axis is located near said elongated opening of said elongated furnace.

* * * * *